US011873132B2

(12) United States Patent
Sasaki

(10) Patent No.: US 11,873,132 B2
(45) Date of Patent: Jan. 16, 2024

(54) DOUBLE CONTAINER

(71) Applicant: YOSHINO KOGYOSHO CO., LTD., Tokyo (JP)

(72) Inventor: Masaaki Sasaki, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 196 days.

(21) Appl. No.: 17/426,430

(22) PCT Filed: Nov. 22, 2019

(86) PCT No.: PCT/JP2019/045856
§ 371 (c)(1),
(2) Date: Jul. 28, 2021

(87) PCT Pub. No.: WO2020/158127
PCT Pub. Date: Aug. 6, 2020

(65) Prior Publication Data

US 2022/0097893 A1 Mar. 31, 2022

(30) Foreign Application Priority Data

Jan. 31, 2019 (JP) ..... 2019-015537

(51) Int. Cl.
*B65D 1/02* (2006.01)
*B65D 79/00* (2006.01)

(52) U.S. Cl.
CPC ..... *B65D 1/0215* (2013.01); *B65D 1/0246* (2013.01); *B65D 1/0276* (2013.01); *B65D 79/0084* (2020.05); *B65D 2501/0027* (2013.01)

(58) Field of Classification Search
CPC ..... B65D 1/0215; B65D 79/0084; B65D 83/0055; B65D 2501/0027
See application file for complete search history.

(56) References Cited

U.S. PATENT DOCUMENTS 5,722,548 A * 3/1998 Hojnoski ..... B65D 39/16 81/3.15
2017/0029157 A1* 2/2017 Taruno ..... F16K 15/06
2018/0370671 A1* 12/2018 Kitora ..... B65D 1/0246

FOREIGN PATENT DOCUMENTS

JP 2000-062745 A 2/2000
JP 2014-046956 A 3/2014
(Continued)

OTHER PUBLICATIONS

Jul. 27, 2021 International Preliminary Report on Patentability issued in International Patent Application No. PCT/JP2019/045856.
(Continued)

*Primary Examiner* — Andrew T Kirsch
(74) *Attorney, Agent, or Firm* — Oliff PLC

(57) ABSTRACT

A double container has an outer layer body and an inner layer body mainly made of a polyester resin and is formed by biaxial stretch blow molding, and includes: a mouth portion; a shoulder portion, gradually increasing in diameter in a downward direction, and having an outward protruding curved shape over a length in a vertical direction in a longitudinal section; a barrel portion; and a bottom portion, wherein the mouth portion has an outside air introduction port for introducing outside air between the outer layer body and the inner layer body, and the double container includes a shoulder rib that is concave or convex as seen from outside and at least extends from an upper end of the shoulder portion to the lower end of the shoulder portion.

2 Claims, 4 Drawing Sheets

(56) References Cited

FOREIGN PATENT DOCUMENTS

| | | | |
|---|---|---|---|
| JP | 2014-091537 | A | 5/2014 |
| JP | 2017-030773 | A | 2/2017 |
| JP | 2017-114555 | A | 6/2017 |
| JP | 2017-178434 | A | 10/2017 |
| JP | 2017-196822 | A | 11/2017 |
| JP | 2017-202853 | A | 11/2017 |
| JP | 2018-087036 | A | 6/2018 |
| JP | 2018-188183 | A | 11/2018 |
| WO | 2018/173748 | A1 | 9/2018 |

OTHER PUBLICATIONS

Jan. 10, 2023 Office Action received in Japanese Patent Application No. 2019-015537.
Sep. 2, 2022 Extended Search Report Issued in European Patent Application No. 19913451.1.
Jan. 28, 2020 International Search Report issued in International Patent Application No. PCT/JP2019/045856.
Jan. 10, 2023 Office Action received in Japanese Patent Application No. JP2019-015537.
Jul. 26, 2022 Office Action issued in Japanese Patent Application No. 2019-015537.
Jun. 24, 2022 Office Action issued in Chinese Patent Application No. 201980090263.7.

* cited by examiner

DOUBLE CONTAINER

TECHNICAL FIELD

The present disclosure relates to a double container.

BACKGROUND

Double containers are conventionally known as containers for containing foods such as food seasonings, e.g. soy sauce, and beverages, cosmetics such as skin lotions, and toiletries such as shampoos, hair conditioners, and liquid soaps as contents.

Such a double container has a double structure in which an inner layer body capable of volume-reduction deformation is located on the inner side of an outer layer body forming the outer shell of the container. The double container can form, for example, a squeeze-type discharge container combined with a discharge cap having a check valve, or a pump-type container combined with a pump. In this case, the contents contained in the inner layer body can be discharged to the outside by squeezing (pressing) the barrel portion of the outer layer body or operating the pump. Meanwhile, by introducing outside air between the inner layer body and the outer layer body from an outside air introduction port provided at a predetermined position, the outer shell shape of the container can be maintained while the inner layer body remains volume-reduction deformed. With such a double container, the contents can be discharged without replacing the contents with outside air inside the inner layer body, so that the contents contained in the inner layer body can be prevented from being in contact with outside air and thus prevented from degradation or degeneration.

The double container can be formed by biaxial stretch blow molding a preform having a double structure in which an inner body is located on the inner side of an outer body (for example, see JP 2017-178434 A (PTL 1)).

CITATION LIST

Patent Literature

PTL 1: JP 2017-178434 A

SUMMARY

Technical Problem

In the conventional double container described in PTL 1, in the case where the outside air introduction port is provided in the mouth portion, there is a possibility that the air passage from the outside air introduction port to the barrel portion is not secured, and outside air cannot be smoothly introduced into the barrel portion after the contents are discharged. Securing the air passage is particularly difficult in the case where the inner layer body is mainly made of a polyester resin such as polyethylene terephthalate.

It could therefore be helpful to provide a double container in which an inner layer body is mainly made of a polyester resin and an air passage from an outside air introduction port provided in a mouth portion to a barrel portion is secured easily.

Solution to Problem

A double container according to an aspect of the present disclosure is a double container that has an outer layer body and an inner layer body located on an inner side of the outer layer body and mainly made of a polyester resin and is formed by biaxial stretch blow molding, the double container comprising: a tubular mouth portion; a shoulder portion connected to a lower end of the mouth portion, gradually increasing in diameter in a downward direction, and having an outward protruding curved shape over a length in a vertical direction in a longitudinal section; a barrel portion connected to a lower end of the shoulder portion; and a bottom portion closing a lower end of the barrel portion, wherein the mouth portion has an outside air introduction port for introducing outside air between the outer layer body and the inner layer body, and the double container comprises a shoulder rib that is concave or convex as seen from outside and at least extends from an upper end of the shoulder portion to the lower end of the shoulder portion.

In the double container according to an aspect of the present disclosure, a plurality of the shoulder rib may be radially arranged in a top view.

Advantageous Effect

It is thus possible to provide a double container in which an inner layer body is mainly made of a polyester resin and an air passage from an outside air introduction port provided in a mouth portion to a barrel portion is secured easily.

DETAILED DESCRIPTION

A double container according to one of the disclosed embodiments will be described in detail below, with reference to the drawings.

Figure 1:
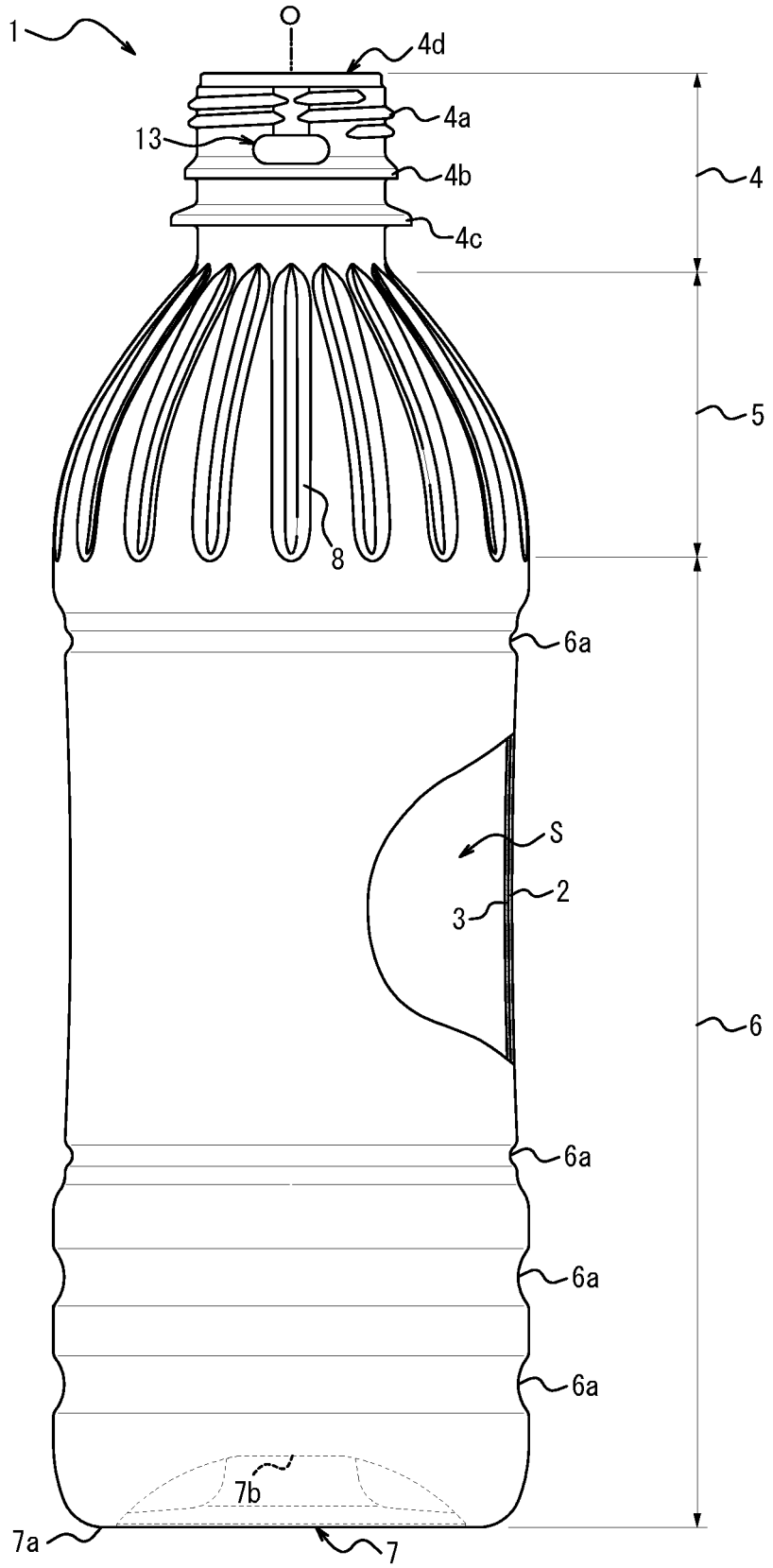
FIG. 1 is a partial sectional side view of a double container according to one of the disclosed embodiments.

As illustrated in FIG. 1, a double container 1 (hereafter also referred to as "container 1") according to this embodiment has an outer layer body 2 and an inner layer body 3 located on the inner side of the outer layer body 2, and is formed by biaxial stretch blow molding.

Figure 2:
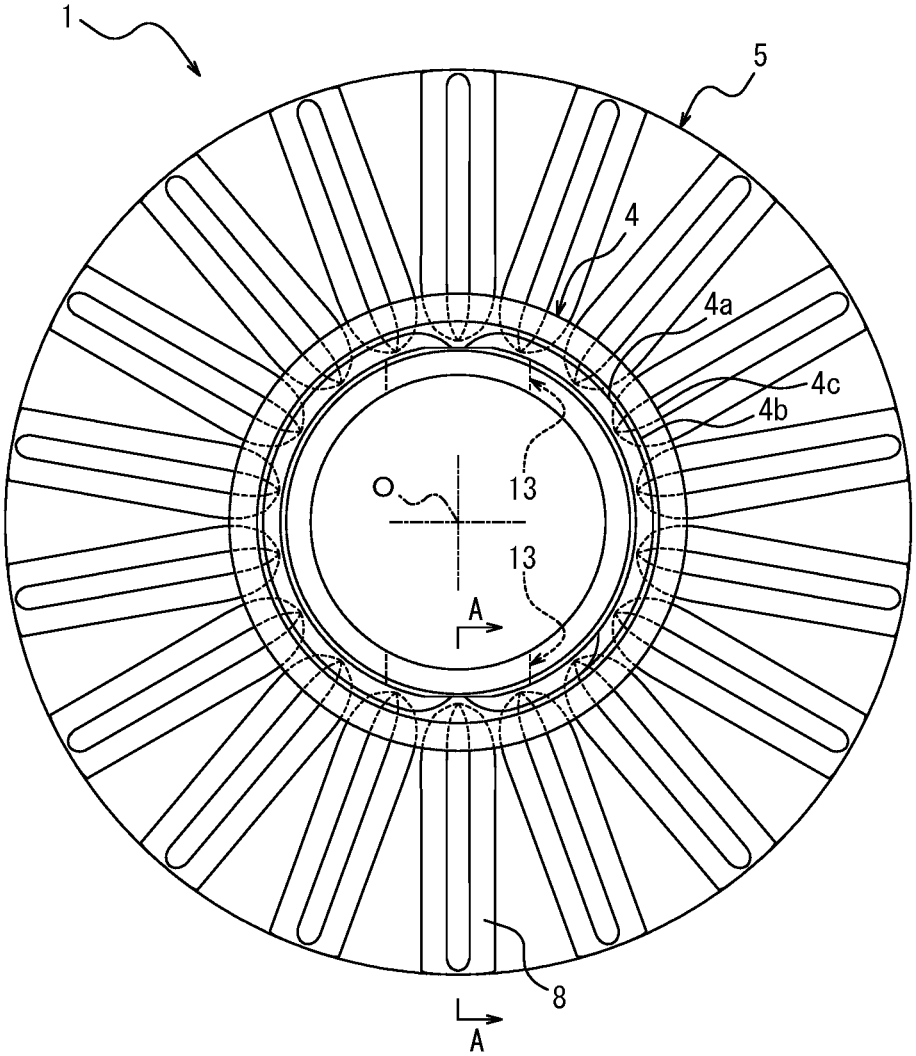
FIG. 2 is a top view of the double container illustrated in FIG. 1.

As illustrated in FIGS. 1 and 2, the container 1 includes an approximately cylindrical mouth portion 4 having a central axis O, a shoulder portion 5 connected to the lower end of the mouth portion 4, a barrel portion 6 connected to the lower end of the shoulder portion 5, and a bottom portion 7 closing the lower end of the barrel portion 6. Herein, the term "vertical direction" (up-down direction) denotes a direction along the central axis O, the term "upward" denotes a direction from the bottom portion 7 to the mouth portion 4 (for example, upward in FIG. 1), and the term "downward" denotes a direction opposite to the upward direction. The term "longitudinal section" denotes a section by a plane including the central axis O, and the term "cross section" denotes a section by a plane perpendicular to the central axis O.

The mouth portion 4 has a male screw 4*a* for screwing the peripheral wall of a discharge cap. Instead of the male screw 4*a*, the mouth portion 4 may have a protrusion of an annular shape or the like that can be undercut-engaged with the peripheral wall of the discharge cap by capping. The mouth portion 4 has an outside air introduction port 13 for introducing outside air between the outer layer body 3 and the inner layer body 2. The detailed structure of the outside air introduction port 13 will be described later. An annular seal protrusion 4*b* centered at the central axis O is provided in a part of the mouth portion 4 lower than the outside air introduction port 13. As a result of the seal protrusion 4*b* being in close contact with the peripheral wall of the discharge cap, air between the outer layer body 3 and the inner layer body 2 can be prevented from leaking from the lower end of the peripheral wall of the discharge cap through the outside air introduction port 13 when the barrel portion 6 is squeezed (pressed). Alternatively, the seal protrusion 4*b* may be omitted. An annular neck ring 4*c* centered at the central axis O is provided in a part of the mouth portion 4 lower than the seal protrusion 4*b*. The shape of the neck ring 4*c* may be changed as appropriate. The neck ring 4*c* may be omitted.

The shoulder portion 5 gradually increases in diameter in the downward direction, and has a curved shape protruding to the outside of the container 1 over a length in the vertical direction in a longitudinal section. The shoulder portion 5 has an approximately circular shape in a cross section.

The barrel portion 6 has an approximately cylindrical shape centered at the central axis O. The barrel portion 6 has four groove-shaped annular ribs 6*a* extending in the circumferential direction. The shape of the barrel portion 6 may be changed as appropriate. For example, the barrel portion 6 may not include the annular ribs 6*a*.

The bottom portion 7 has an annular grounding portion 7*a* centered at the central axis O and a bottom panel 7*b* located on the inner side of the grounding portion 7*a*. The shape of the bottom portion 7 may be changed as appropriate.

The outer layer body 2 is mainly made of polyethylene terephthalate (PET). The outer layer body 2 forms the outer shell of the container 1, and the part of the outer layer body 2 forming the barrel portion 6 has flexibility of being deformable by squeezing operation and resilience of being restorable by an elastic force after deformation. For example, in the case where the container 1 forms a pump-type container, the outer layer body 2 may not have such flexibility and resilience. The main material of the outer layer body 2 is not limited to PET. For example, the main material of the outer layer body 2 may be a polyester resin other than PET, such as polytrimethylene terephthalate (PTT), polybutylene terephthalate (PBT), or polyethylene naphthalate (PEN), or a polyolefin resin such as polypropylene (PP) or polyethylene (PE). The main material of the outer layer body 2 is preferably a polyester resin. The outer layer body 2 is not limited to a single layer structure, and may have a multi-layer structure that can improve the barrier property and the like.

The inner layer body 3 is mainly made of PET. The main material of the inner layer body 3 is not limited to PET. For example, the main material of the inner layer body 3 may be a polyester resin other than PET, such as polytrimethylene terephthalate (PTT), polybutylene terephthalate (PBT), or polyethylene naphthalate (PEN). The inner layer body 3 has a bag shape thinner than the outer layer body 2. A containing space S connected to an upper end opening 4*d* of the mouth portion 4 is formed inside the inner layer body 3. The containing space S is capable of containing any of foods such as food seasonings, e.g. soy sauce, and beverages, cosmetics such as skin lotions, and toiletries such as shampoos, hair conditioners, and liquid soaps as contents. The contents are not limited to foods, cosmetics, or toiletries. The inner layer body 3 is not limited to a single layer structure, and may have a multi-layer structure that can improve the barrier property, the content resistance, and the like.

In this embodiment, the main material of each of the outer layer body 2 and the inner layer body 3 is biaxially stretchable PET. An example of such biaxially stretchable PET is homo-PET. Alternatively, other types of PET such as IPA (isophthalic acid) modified PET and CHDM modified PET may be used. The PET forming the outer layer body 2 and the PET forming the inner layer body 3 may be different.

Figure 4:
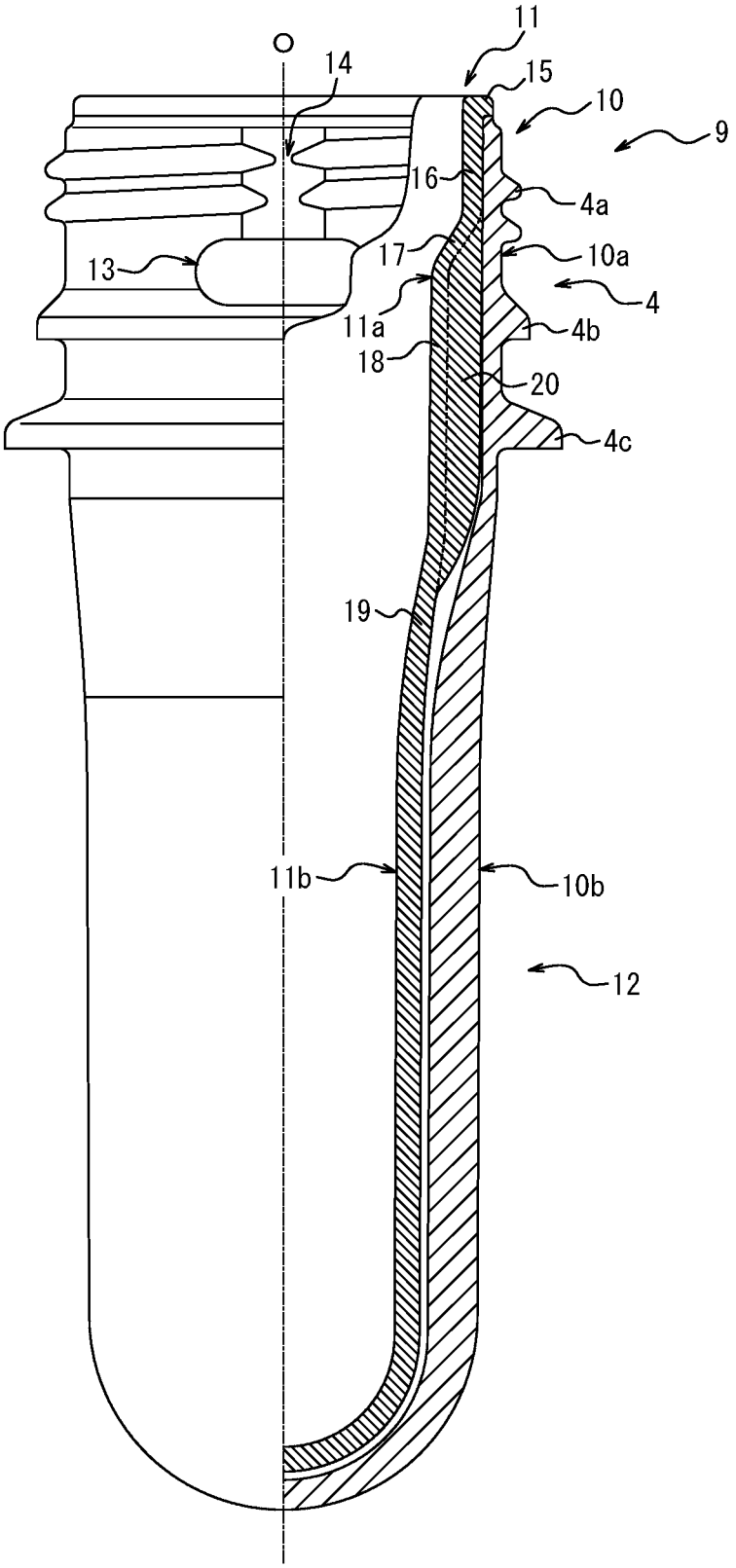
FIG. 4 is a partial sectional side view of a preform before being molded into the double container illustrated in FIG. 1.

The container 1 is formed by biaxial stretch blow molding a preform 9 illustrated in FIG. 4. The preform 9 has an outer body 10 that forms the outer layer body 2 and an inner body 11 that forms the inner layer body 3. In this embodiment, the preform 9 has a double preform structure composed of the outer body 10 and the inner body 11. The preform 9 includes a mouth portion 4 having substantially the same structure as the mouth portion 4 in the container 1 as it is not substantially stretched in the biaxial stretch blow molding. A bottomed cylindrical (test tube shape) preform barrel portion 12 is connected below the mouth portion 4.

The outer body 10 has a cylindrical outer mouth portion 10*a* that forms the mouth portion 4. A male screw 4*a*, a seal protrusion 4*b*, and a neck ring 4*c* are provided on the outer peripheral surface of the outer mouth portion 10*a*. The outer mouth portion 10*a* has an outside air introduction port 13 that is a horizontally long through hole, in the part between the male screw 4*a* and the seal protrusion 4*b*. In this embodiment, the outer mouth portion 10*a* has two outside air introduction ports 13 with the central axis O being located therebetween. The number of outside air introduction ports 13 and the arrangement and shape of the outside air introduction ports 13 may be changed as appropriate. The male screw 4*a* has a notch 14 directly above the outside air introduction port 13. An outside air inlet provided in the discharge cap and the outside air introduction port 13 communicate via the notch 14. Alternatively, the male screw 4*a* may not have the notch 14.

An outer barrel portion 10*b* that forms the preform barrel portion 12 is connected below the outer mouth portion 10*a*. The outer barrel portion 10*b* has an upper part that gradually decreases in outer diameter and gradually increases in thickness in the downward direction, a cylindrical middle part that has an approximately uniform thickness in the vertical direction, and a semispherical lower part that closes the lower end of the middle part. The shape of the outer barrel portion 10*b* may be changed as appropriate.

The inner body 11 includes a stepped cylindrical inner mouth portion 11*a* that forms the mouth portion 4. The inner mouth portion 11*a* has an annular flange 15 placed on the upper end of the outer mouth portion 10*a*, a cylindrical upper tube 16 vertically suspended from the inner peripheral edge of the flange 15 and in contact with the inner surface of the outer mouth portion 10*a*, a conical inclined tube 17 that decreases in diameter in the downward direction from the lower end of the upper tube 16, and part of a cylindrical lower tube 18 (i.e. part except a lower part) vertically suspended from the lower end of the inclined tube 17. The upper end of the inclined tube 17 is located higher than the upper end of the pair of outside air introduction ports 13.

An inner barrel portion 11*b* that forms the preform barrel portion 12 is connected below the inner mouth portion 11*a*. The inner barrel portion 11*b* has an upper part composed of the lower part of the lower tube 18 and an inclined portion 19 that gradually decreases in outer diameter and gradually increases in thickness in the downward direction from the lower part, a cylindrical middle part that has an approximately uniform thickness in the vertical direction, and a semispherical lower part that closes the lower end of the middle part. The shape of the inner barrel portion 11*b* may be changed as appropriate according to the shape of the outer barrel portion 10*b*.

The inner body 11 has projection pieces 20 extending in the vertical direction from the upper end of the inclined tube 17 to the upper part of the inclined portion 19. Three projection pieces 20 are arranged on each of the two sides of an axis passing through both of the pair of outside air introduction ports 13 in a top view so that, even after biaxial stretch blow molding, a space for air passage can be favorably maintained between the outer layer body 2 and the inner layer body 3 around and below the outside air introduction ports 13. The number of projection pieces 20 and the arrangement and shape of the projection pieces 20 may be changed as appropriate. The projection pieces 20 may be omitted.

The preform 9 can be molded into the container 1 by biaxial stretch blow molding that involves stretching in the axial direction by a stretching rod and stretching in the circumferential direction by blowing pressurized air (or liquid as contents). The container 1 formed in this way has, in the shoulder portion 5, a plurality of (18 in this embodiment) shoulder ribs 8 formed along the shape of the cavity of the mold for blow molding. In FIGS. 1 and 2, only one of the plurality of shoulder rib 8 is given the reference sign.

Figure 3:
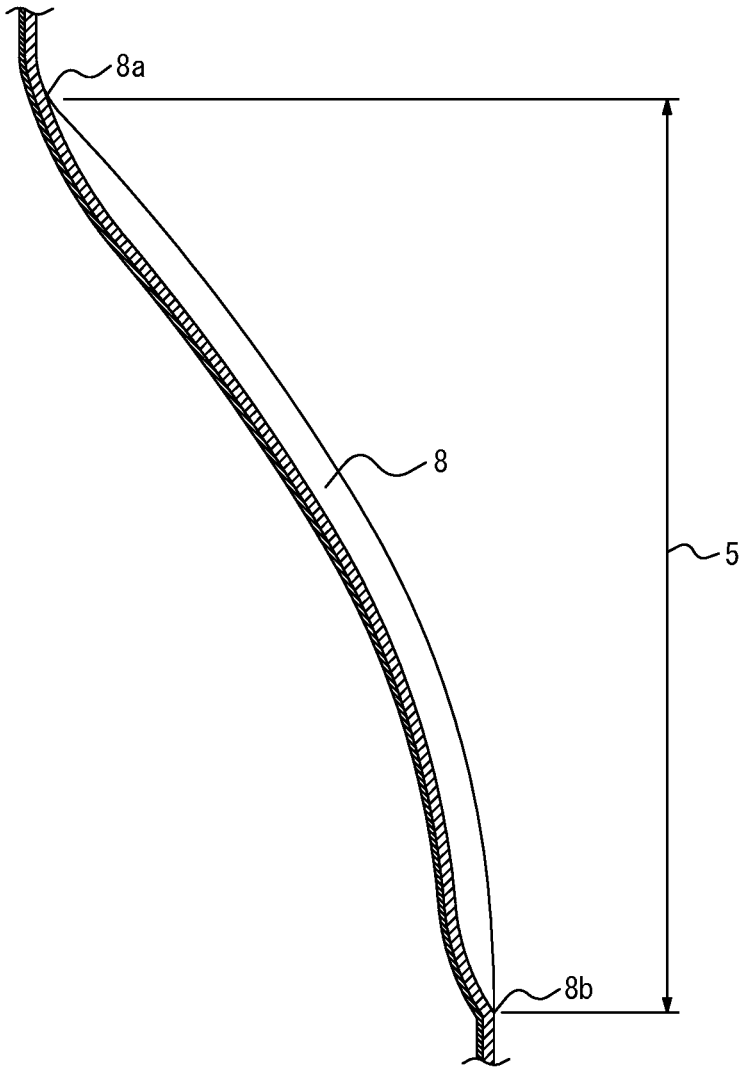
FIG. 3 is a sectional view along A-A in FIG. 2.

As illustrated in FIGS. 1 to 3, in this embodiment, the shoulder ribs 8 are arranged radially around the central axis O in a top view. That is, each shoulder rib 8 extends in the radial direction of the central axis O in a top view. The shoulder ribs 8 are spaced at regular intervals in the circumferential direction of the central axis O. The number of shoulder ribs 8 and the arrangement of the shoulder ribs 8 in the circumferential direction of the central axis O may be changed as appropriate. Each shoulder rib 8 is concave as seen from outside the container 1, and extends from the upper end to the lower end of the shoulder portion 5. That is, each shoulder rib 8 has an upper end 8*a* located at the upper end of the shoulder portion 5 and a lower end 8*b* located at the lower end of the shoulder portion 5. Herein, the expression "the upper end 8*a* of the rib 8 is located at the upper end of the shoulder portion 5" includes not only the case where the upper end 8*a* of the rib 8 and the upper end of the shoulder portion 5 match but also the case where the upper end 8*a* of the rib 8 deviates from the upper end of the shoulder portion 5 upward or downward by at most such an extent that is approximately equal to the thickness of the outer layer body 2. The expression "the lower end 8*b* of the rib 8 is located at the lower end of the shoulder portion 5" includes not only the case where the lower end 8*b* of the rib 8 and the lower end of the shoulder portion 5 match but also the case where the lower end 8*b* of the rib 8 deviates from the lower end of the shoulder portion 5 upward or downward by at most such an extent that is approximately equal to the thickness of the outer layer body 2. Each shoulder rib 8 at least extends from the upper end to the lower end of the shoulder portion 5. Each shoulder rib 8 has a U cross sectional shape that gradually decreases in width inward in the radial direction of the central axis O, substantially throughout its length.

In this embodiment, by using biaxial stretch blow molding with the double-structure preform, the adhesion of the inner layer body 3 to the outer layer body 2 is reduced and the air passage after discharging the contents is secured easily as compared with the case where extrusion blow molding (EBM) by laminated parison in which the inner layer body 3 and the outer layer body 2 are integrated is used. However, the structure in which the shoulder portion 5 has an outward protruding curved shape over a length in the vertical direction as in this embodiment, combined with the use of a polyester resin having a higher tensile elastic modulus (Young's modulus) than a polyolefin resin or the like as the main material of the inner layer body 3, makes it difficult for the inner layer body 3 to deform inward in the shoulder portion 5, so that it is difficult to secure the air passage in the shoulder portion 5. In view of this, in this embodiment, a plurality of shoulder ribs 8 that at least extend from the upper end to the lower end of the shoulder portion 5 and are arranged radially in a top view are provided. In the double the container 1 according to this embodiment, the plurality of shoulder ribs 8 make it possible to stably secure the air passage between the outer layer body 2 and the inner layer body 3 in the shoulder portion 5, so that outside air can be smoothly introduced into the barrel portion 6 after the contents are discharged.

The foregoing embodiment is merely an example of an embodiment of the present disclosure, and various changes can be made without departing from the scope of the present disclosure.

Although the mouth portion 4, the shoulder portion 5, and the barrel portion 6 in the container 1 have a circular tubular shape in a cross section in the foregoing embodiment, the present disclosure is not limited to such. For example, the mouth portion 4, the shoulder portion 5, and the barrel portion 6 may have a polygonal or elliptical tubular shape in a cross section.

Although each outside air introduction port 13 is a through hole passing through the part (the outer mouth portion 10*a*) forming the mouth portion 4 in the outer layer body 2 in the foregoing embodiment, the present disclosure is not limited to such. For example, the outside air introduction port 13 may be provided between the part (the outer mouth portion 10*a*) forming the mouth portion 4 in the outer layer body 2 and the part (the inner mouth portion 11*a*) forming the mouth portion 4 in the inner layer body 3. For example, the outside air introduction port 13 may be a groove continuous from the outer peripheral edge of the flange 15 of the inner mouth portion 11*a* to the lower end of the upper tube 16 on the lower surface of the flange 15 and the outer peripheral surface of the upper tube 16, and/or a groove continuous from the outer peripheral edge of the upper end surface of the outer mouth portion 10*a* to a position beyond the lower end of the upper tube 16 on the upper end surface of the outer mouth portion 10*a* and the inner peripheral surface of the outer mouth portion 10*a*.

Although the plurality of shoulder ribs 8 are concave as seen from outside the container 1 in the foregoing embodiment, the present disclosure is not limited to such. The plurality of shoulder ribs 8 may be convex as seen from outside the container 1. Although the plurality of shoulder ribs 8 are arranged radially in a top view in the foregoing embodiment, the present disclosure is not limited to such. The plurality of shoulder ribs 8 may each extend in a direction inclined with respect to the radial direction of the central axis O in a top view, or have a curved or bent shape in a top view. The number of shoulder ribs 8 is not limited to two or more, and may be one.

REFERENCE SIGNS LIST

1 double container
2 outer layer body

3 inner layer body
4 mouth portion
4*a* male screw
4*b* seal protrusion
4*c* neck ring
4*d* upper end opening
5 shoulder portion
6 barrel portion
7 bottom portion
7*a* grounding portion
7*b* bottom panel
8 shoulder rib
9 preform
10 outer body
10*a* outer mouth portion
10*b* outer barrel portion
11 inner body
11*a* inner mouth portion
11*b* inner barrel portion
12 preform barrel portion
13 outside air introduction port
14 notch
15 flange
16 upper tube
17 inclined tube
18 lower tube
19 inclined portion
20 projection piece
O central axis
S containing space

The invention claimed is:

1. A double container that has an outer layer body and an inner layer body located on an inner side of the outer layer body and mainly made of a polyester resin and is formed by biaxial stretch blow molding, the double container comprising:

a tubular mouth portion;

a shoulder portion connected to a lower end of the mouth portion, gradually increasing in diameter in a downward direction, and having an outward protruding curved shape over a length in a vertical direction in a longitudinal section;

a barrel portion connected to a lower end of the shoulder portion; and a bottom portion closing a lower end of the barrel portion, wherein the mouth portion has an outside air introduction port for introducing outside air between the outer layer body and the inner layer body, the mouth portion is formed by an outer mouth portion of the outer layer body and an inner mouth portion of the inner layer body, the mouth portion comprises an upper tube in contact with an inner surface of the outer mouth portion, an inclined tube decreasing in diameter in the downward direction from the lower end of the upper tube, and a part suspended from the lower end of the inclined tube, the inner mouth portion comprises a projection piece extending from an upper end of the inclined tube in the downward direction such that a space for air passage can be maintained between the outer layer body and the inner layer body around and below the outside air introduction port, and the double container comprises a shoulder rib that is concave or convex as seen from outside and at least extends from an upper end of the shoulder portion to the lower end of the shoulder portion.

2. The double container according to claim 1, wherein a plurality of the shoulder ribs are radially arranged in a top view.

* * * * *